US009265404B2

(12) United States Patent
Fey et al.

(10) Patent No.: US 9,265,404 B2
(45) Date of Patent: Feb. 23, 2016

(54) WASHWARE CARRIER FOR ACCOMMODATING WASHWARE IN A VARIABLE MANNER

(75) Inventors: Janina Fey, München (DE); Wolfgang Kaczmarek, Schwindegg (DE); Franz Kiechle, Günzburg (DE); Thomas Knöller, Neusäß (DE); Hermann Moser, Altenmünster (DE); Thomas Ott, Neubiberg (DE); Nico Zendel, München (DE)

(73) Assignee: BSH Hausgeraete GmbH, Munich (DE)

( * ) Notice: Subject to any disclaimer, the term of this patent is extended or adjusted under 35 U.S.C. 154(b) by 110 days.

(21) Appl. No.: 14/235,465

(22) PCT Filed: Jul. 25, 2012

(86) PCT No.: PCT/EP2012/064556

§ 371 (c)(1),
(2), (4) Date: Feb. 4, 2014

(87) PCT Pub. No.: WO2013/020809

PCT Pub. Date: Feb. 14, 2013

(65) Prior Publication Data

US 2014/0174486 A1 Jun. 26, 2014

(30) Foreign Application Priority Data

Aug. 9, 2011 (DE) ..... 10 2011 080 698

(51) Int. Cl.
*A47L 15/50* (2006.01)

(52) U.S. Cl.
CPC ..... *A47L 15/503* (2013.01); *A47L 15/502* (2013.01)

(58) Field of Classification Search
CPC ..... A47L 15/503
See application file for complete search history.

(56) References Cited

U.S. PATENT DOCUMENTS

| | | | | |
|---|---|---|---|---|
| 3,612,285 | A | 10/1971 | Mason | |
| 2003/0089672 | A1 | 5/2003 | VanLandingham | |
| 2006/0254992 | A1 * | 11/2006 | Lim | 211/41.9 |
| 2008/0302740 | A1 | 12/2008 | Moser et al. | |

FOREIGN PATENT DOCUMENTS

| | | | |
|---|---|---|---|
| DE | 4037070 | A1 | 5/1992 |
| EP | 1199025 | B1 | 2/2005 |
| WO | 2006058572 | A1 | 6/2006 |

OTHER PUBLICATIONS

International Search Report PCT/EP2012/064556 dated Dec. 11, 2012.
Report of Examination DE 10 2011 080 698.9 dated Jun. 18, 2012.

* cited by examiner

*Primary Examiner* — Jason Ko
(74) *Attorney, Agent, or Firm* — James E. Howard; Andre Pallapies

(57) ABSTRACT

A washware carrier for the accommodation of washware to be washed in dishwasher includes a base portion, and a multiplicity of retainers for the washware. The retainers are arranged, in a row, with a first plurality of retainers being fixed and a second plurality of retainers configured for swing action. The first and second pluralities of retainers are arranged in a random sequence.

26 Claims, 2 Drawing Sheets

WASHWARE CARRIER FOR ACCOMMODATING WASHWARE IN A VARIABLE MANNER

BACKGROUND OF THE INVENTION

The invention relates to a washware carrier, in particular a crockery basket or a cutlery drawer, for the accommodation of washware to be washed in a dishwasher, with a base portion on which are arranged, in a row, a multiplicity of retainers for the washware. The invention further relates to a dishwasher with a washware carrier.

Washware carriers for the accommodation of washware for use in dishwashers, in particular household dishwashers, are generally known. A distinction is here frequently drawn between crockery baskets, which essentially serve to accommodate items of crockery, such as plates, cups, glasses etc., and cutlery drawers, which essentially serve to accommodate items of cutlery, such as knives, forks and spoons. An important objective in the design of such washware carriers, regardless of whether they are crockery baskets or cutlery drawers, is to afford the user the maximum flexibility when loading the washware carrier. Thus subject to optimal utilization of the available space, it should be possible to load items of crockery or items of cutlery of various dimensions, e.g. plates and dishes of different depths or knives with handles of different widths, into the washware carrier in a convenient manner. A series of proposals have been advanced for the creation of this flexibility.

Thus for example a crockery basket for the accommodation of a multiplicity of different items of crockery is known from DE 10 2004 035 726 A1, which has a rake-like retaining device made up of a multiplicity of spines. In order to increase the flexibility of the crockery basket the spines can be swung between various pivot positions, wherein the retaining device is made up of at least two folding rows of spines, which can be swung between the different pivot positions independently of each other. According to one embodiment it is also provided for the spines of a folding row of spines to be cranked, so that the spines of all folding rows of spines in a first pivot position come to rest along an axis of rotation in one line and orientation. The spines of each of the folding rows of spines can here be arranged alternately at the same distance from each other. If a retaining device then has precisely two folding rows of spines, then in a second pivot position the distance between two successive spines can be doubled compared with the first pivot position. However this solution is relatively costly from the perspective of design engineering and production technology and additionally requires a relatively large amount of installation space.

BRIEF SUMMARY OF THE INVENTION

It is the object of the present invention to provide a washware carrier which offers a high degree of flexibility as regards the accommodation of washware coupled with simple design engineering and production technology and efficient utilization of installation space.

According to the invention the object is achieved by a washware carrier), in particular crockery basket or cutlery drawer, for the accommodation of washware to be washed in dishwasher, with a base portion, on which are arranged, in a row, a multiplicity of retainers for the washware, wherein a first number of multiplicity of retainers are embodied in a fixed manner and a second number of multiplicity of retainers for swing action, and wherein swing-action and fixed retainers are arranged in a changing sequence. Advantageous embodiments and developments of the invention are specified in the dependent claims.

Based on a washware carrier, in particular crockery basket or cutlery drawer, for the accommodation of washware to be cleaned in a dishwasher with a base portion, on which are arranged, in a row, a multiplicity of retainers for the washware, the basic idea of the invention resides in the provision of a first number of the multiplicity of retainers in a fixed manner and a second number of the multiplicity of retainers for swing action, wherein swing-action and fixed retainers are arranged in changing sequence.

In a first pivot position—hereinafter designated the usage position—the swing-action retainers are arranged standing up from the base portion, preferably approximately vertically, and thus in a row with the fixed retainers which likewise stand up from the base portion, preferably likewise approximately vertically. In this way, a small distance is formed between two successive retainers for the retention of flat items of crockery, e.g. dinner plates, or narrow items of cutlery, for example narrow knife handles. In a second pivot position—hereinafter designated the non-usage position—the swing-action retainers are folded down, so that they come to rest approximately horizontally on the base portion of the washware carrier. The distance between two adjacent retainers is hereby now only determined by the fixed retainers which still remain in the upright attitude. A greater distance is thus formed, at least in partial areas, which also enables deeper items of crockery, e.g. soup plates, or wider items of cutlery, for example broad knife handles, to be accommodated. As according to the invention only a number of the retainers are embodied for swing action, the inventive washware carrier is characterized in particular by a simple design in terms of engineering and production.

According to one embodiment of the invention, swing-action and fixed retainers are arranged in alternating sequence. In this way the distance between, in each case, two adjacent retainers can be increased over the entire length of the retainers arranged in a row.

To achieve the ability of the retainers to fold, these can for example be mounted on one axle. If all swing-action retainers are mounted on a common axle this contributes to simplified design engineering.

The swing-action retainers can here be mounted rotatably on the axle. It is however advantageous if the swing-action retainers are mounted in a torque-free manner on a common rotatable axle. In this way it is possible in a simple manner to fold all retainers for swing action down or out jointly. Here and hereinafter, "folding down" refers to bringing the retainers from their usage position into their non-usage position, while "folding out" means bringing the retainers from their non-usage position in their usage position. In addition to these positions, further positions, in particular intermediate positions can also of course be provided for the swing-action retainers.

In order to simplify the folding-down and folding-out of the swing-action retainers for the user, an actuating element can be embodied on the rotatable axle. The actuating element here can either be embodied in one piece with the rotatable axle or also be fastened to this in a torque-free manner.

At least in the usage position, in which they are arranged in a row with the fixed retainers the swing-action retainers can advantageously be locked. Such a locking function can for example be realized in the form of a latching connection. If an actuating element is provided for, this can also advantageously serve as a latching element, which in the usage position engages with a corresponding counterlatching element on the washware carrier. A corresponding locking function can of course also be provided for in the non-usage position or also in further provided pivot positions of the swing-action retainers.

According to one embodiment of the invention the fixed retainers have in each case at least two fastening portions, with which the retainers are fastened to the base portion, and a central portion, which connects the at least two fastening portions to each other. On the one hand the mechanical stability of the retainers is thereby increased and on the other the positioning of items of crockery or items of cutlery simplified, because when inserting items of crockery or items of cutlery, a user simply orients themselves via the central portion, wherein the central portion connecting the two fastening portions increases the stability of the retainers.

It is particularly preferable for the central portions to be arranged at a distance from the base portion. This can for example be achieved in that the fixed retainers are essentially embodied to be M-shaped or essentially U-shaped or essentially V-shaped.

Such an embodiment of the fixed retainers results in the creation of a free space underneath the central portions, which can advantageously be used to accommodate the axle of the swing-action retainers. In this way the available installation space, which is as a rule very limited, can be utilized in a particularly effective manner.

In order to minimize hindrance of the accommodation of washware between the fixed retainers in the non-usage position, it is sensible to embody the swing-action retainers as folding spines. In the folded-down state theses can then rest directly on the base portion, so that they do not influence the loading of the washware carrier with washware.

The inventive washware carrier can be arranged as a crockery basket, in particular as a lower basket or as an upper basket, or as a cutlery drawer in a dishwasher.

A dishwasher, in particular a household dishwasher, with an inventive washware carrier offers the possibility of flexible accommodation of items of crockery or items of cutlery, either for a large number of flat items of crockery or items of cutlery or a smaller number of deeper items of crockery or cutlery.

Except for example in the cases of clear dependencies or incompatible alternatives the advantageous embodiments and developments of the invention explained above and/or specified in the subsidiary claims can here be applied not just individually but also in any desired combination with each other.

BRIEF DESCRIPTION OF THE DRAWINGS

The invention and its advantageous embodiments and developments and their advantages are explained in greater detail below on the basis of drawings, wherein in a schematic diagram in each case illustrating the principle.

DETAILED DESCRIPTION OF EXEMPLARY EMBODIMENTS OF THE PRESENT INVENTION

Figure 1:
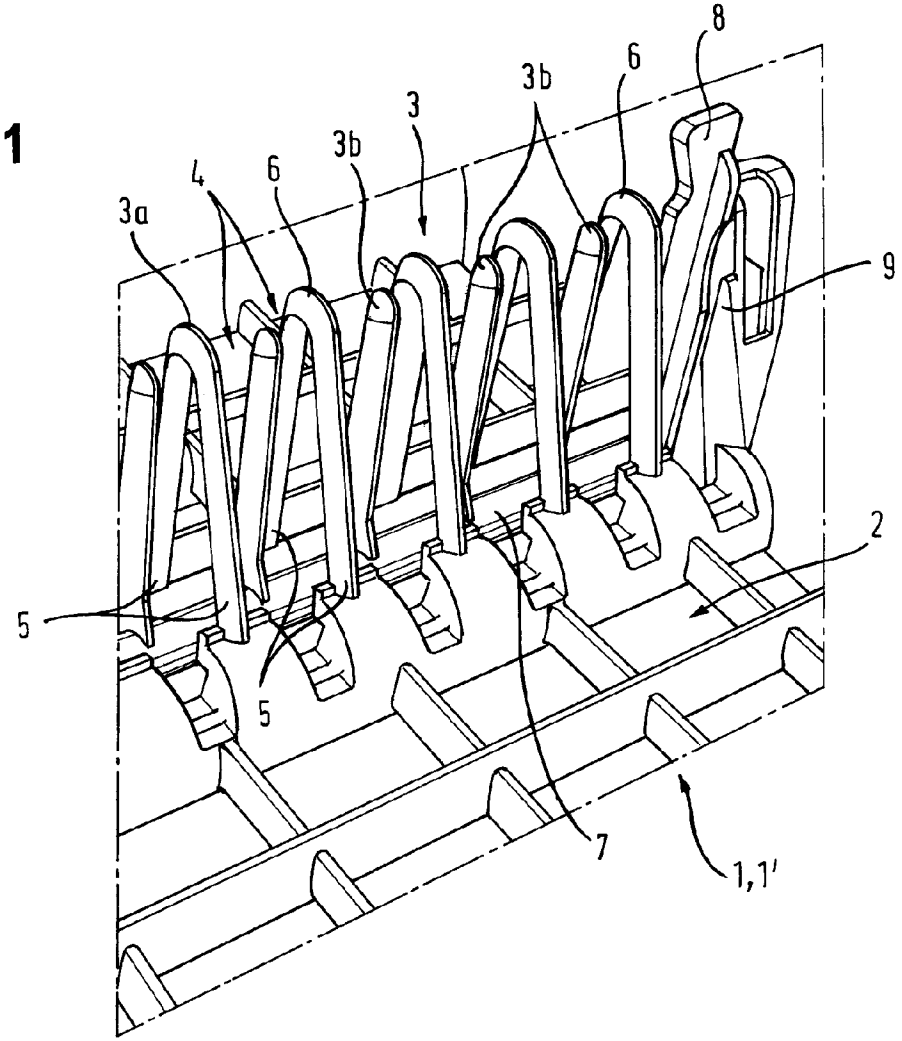
FIG. 1 shows a three-dimensional representation of a section of an inventive washware carrier with swing-action retainers in the usage position and FIG. 2 shows a three-dimensional representation of a section of the inventive washware carrier according to FIG. 1 with swing-action retainers non-usage in the position.

In the figures which follow, the same parts are identified with the same reference characters.

Only those parts necessary for understanding of the invention are provided with reference characters and illustrated. The parts shown in the figures are not shown to scale, but are enlarged for the purposes of greater clarity.

FIG. 1 shows a section of an inventive washware carrier 1 for the accommodation of washware to be washed in a dishwasher which is not shown, in particular a household dishwasher. By way of example, the washware carrier 1 is embodied as cutlery drawer 1', which essentially serves to accommodate items of cutlery, but could also be embodied as a crockery basket, which essentially serves to accommodate items of crockery. The washware carrier 1 has a base portion 2, on which are arranged, in a row, a multiplicity of retainers 3 for the washware. Two adjacent retainers 3 in each case form an accommodation space 4, in that an item of washware, as in the present exemplary embodiment of the cutlery drawer 1' , a knife or a spoon or a fork for example, can be inserted.

The retainers 3 are here embodied in such a way that a first number of the multiplicity of retainers 3 are embodied as fixed retainers 3*a* and a second number of the multiplicity of retainers 3 are embodied as swing-action retainers 3*b*. In the exemplary embodiment shown the swing-action retainers 3*a* and the fixed retainers 3*b* are arranged in an alternating sequence. For the invention to be capable of implementation it is however sufficient if swing-action and fixed retainers 3*a* and 3*b* respectively are arranged in any variable sequence. Thus it is for example also conceivable for two or more swing-action retainers 3*b* to be arranged between two fixed retainers 3*a* in each case. It is likewise possible for a swing-action retainers 3*b* to be provided for only in each case after a series of two or more fixed retainers 3*a*. An irregular sequence of fixed and swing-action retainers 3*a* or 3*b* respectively is also conceivable.

FIG. 1 shows the swing-action retainers 3*b* in a first pivot position designated as the usage position, in which it stands up approximately vertically from the base portion 2. The swing-action retainers 3*a* are thus arranged in a row with the fixed retainers 3*a* which are likewise standing up approximately vertically from the base portion 2. In addition to a vertical orientation, an oblique or slanting orientation is also possible, depending on the concrete application. It is however advantageous to select the same orientation in each case for the fixed retainers 3*a* and the swing-action retainers 3*b* in their usage position, so that the retainers 3 are in each case arranged parallel to each other.

Through their design, which is embodied for bilateral retention, the retainers 3 arranged in a row permit the secure retention of a maximum number of items of cutlery, or in the case of a crockery basket, items of crockery, with a minimum number of retainers 3, during a wash procedure in the washware carrier. Depending on the particular application case, the row of retainers 3 can extend over the entire length or width of the washware carrier or also just a section thereof. It is also conceivable to provide for a changing sequence of fixed and swing-action retainers 3*a* or 3*b* respectively in just a section of an entire row of retainers 3, and in the remaining section or sections to provide exclusively fixed retainers 3*a* or swing-action retainers 3*b*. A washware carrier 1 can of course also be equipped with multiple rows of retainers 3 with a changing sequence of fixed and swing-action retainers 3*a* or 3*b* respectively.

The fixed retainers 3*a* in each case have two fastening portions 5, which are fastened to the base portion 2 of the cutlery drawer 1'. The two fastening portions 5 are in each case connected to each other by means of a central portion 6. In the exemplary embodiment represented, the central portions 6 are embodied with a curved shape, so that the two fastening portions 5 and the central portion 6 have an unkinked, loop-like form. The two fastening portions 5 and the central portion 6 here have the same cross-section, which is preferably embodied in triangular form, which minimizes the contact area between the edges and an abutting item of washware, and thus guarantees that the build-up of marks during a drying process is reduced. In addition to the essentially V-shaped embodiment of the fixed retainers 6*a* shown, numerous other embodiments, such as for example essentially M-shaped or essentially U-shaped fixed retainers are possible. In contrast to the embodiment shown it is also possible that the individual fixed retainers 3*a* as also the swing-action retainers 3*b,* do not have a uniform shape.

According to the embodiment shown, in the usage position of the swing-action retainers 3*b* a swing-action retainers 3*b* is in each case arranged between two adjacent fixed retainers 3*a*. The swing-action retainers 3*b* are here mounted on a common rotatable axle 7. Also embodied on this axle 7 is an actuating element 8, which in the exemplary embodiment shown is embodied in one piece with the axle 7, which can however alternatively also be fastened to the axle 7 in a torque-free manner. In the usage position of the swing-action retainers 3*b,* the actuating element 8 is here oriented approximately vertically, corresponding to the swing-action retainers 3*b,* and serves to facilitate simple folding-down of the swing-action retainers 3*b* by the user. Through the common mounting of the swing-action retainers 3*b* on the common axle 7 in a torque-free manner, folding-down of the swing-action retainers 3*b* from its usage position into a second pivot position (cf. FIG. 2) designated as the non-usage position is enabled in a simple manner. It is however not necessary in principle for the applicability of the invention for all swing-action retainers 3*b* to be capable of being folded down jointly and/or simultaneously. To this extent the swing-action retainers 3*b* can also be mounted on an axle individually or in groups. The axle can here either be embodied in rotatable form and the swing-action retainers 3*b* fastened to this in a torque-free manner, in particular even embodied in one piece with this. As an alternative to this, however, a torque-free axle can also be provided, on which the swing-action retainers 3*b* are mounted in a rotatable manner. Neither is it of significance for the applicability of the invention that all swing-action retainers 3*b* are mounted on a common axle 7. It is likewise in principle irrelevant to the applicability of the invention whether the swing-action retainers 3*b* or also the fixed retainers 3*a* are connected to the axle 7 or the base portion 2 of the washware carrier 1 in a releasable or non-releasable manner.

In the embodiment shown, the actuating element 8 serves at the same time as a latching element, which in the usage position of the swing-action retainers 3*b* engages with a counterlatching element 9, which is for example arranged on an essentially vertical wall section of the washware carrier 1, and the swing-action retainers 3*b* is in this way locked in its usage position. In the exemplary embodiment shown, the actuating element 8 is here embodied in elastic form, so that by means of a slight pivoting movement towards the row of retainers 3 it can be disengaged from the counterlatching element 9, which then enables the swing-action retainers 3*b* to be folded down. As an alternative to use of the actuating element 8, a locking function of the swing-action retainers 6*b* in the usage position can also be realized in any other desired manner.

In order to make the best possible use of the available installation space, the common axle 7 of the swing-action retainers 3*b* is arranged in the area underneath the central portions 6 of the fixed retainers 3*a*. If the central portions 6 of the fixed retainers 3*a* are arranged as in the exemplary embodiment shown, at a distance from the base portion 2 of the washware carrier 1, the common axle 7 can even be arranged in an area underneath the central portions 6 or above or level with the base portion 2, so that no installation space in the area underneath the washware carrier 1 is taken up.

Figure 2:
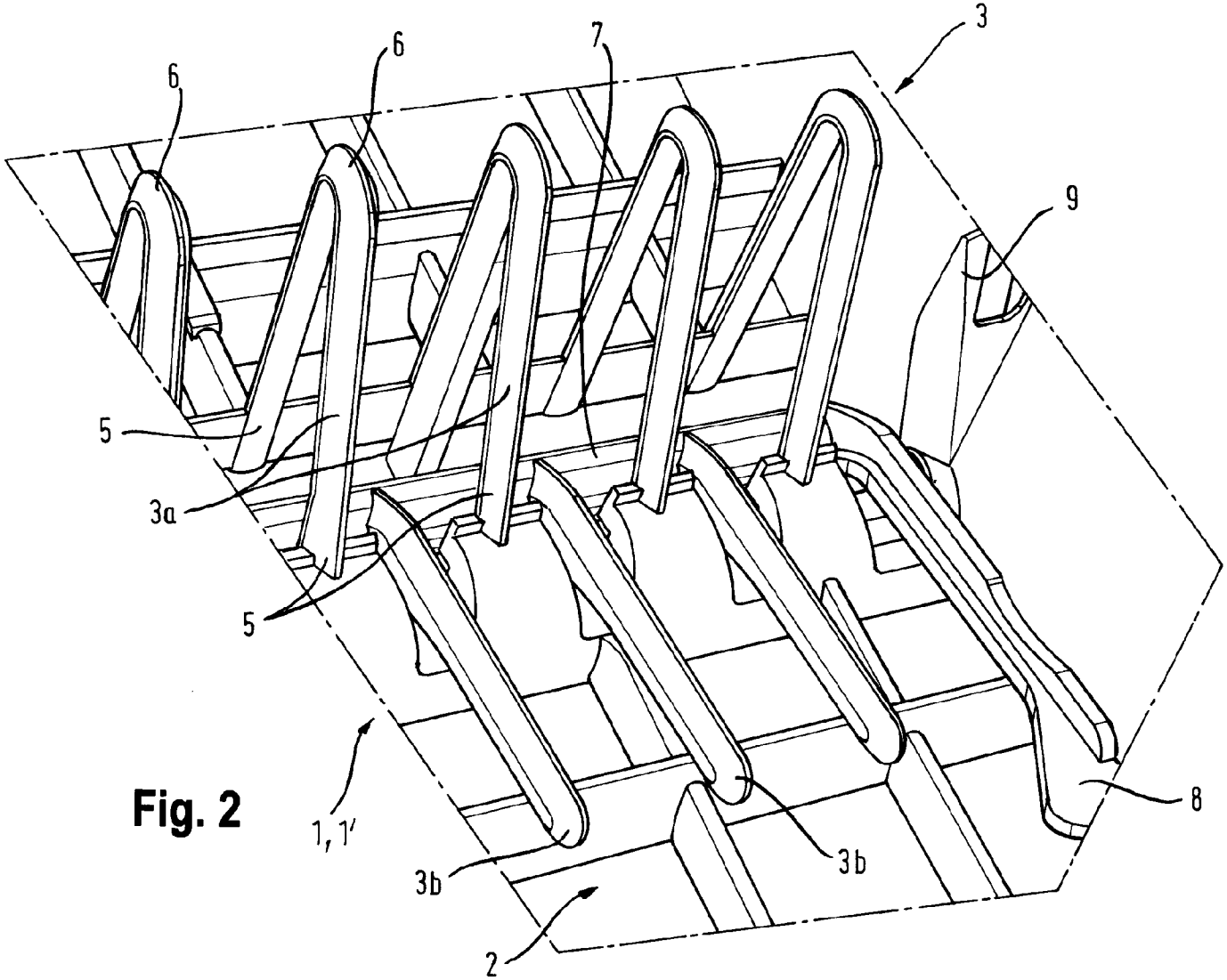

FIG. 2 shows the washware carrier 1 according to FIG. 1, wherein the swing-action retainers 3*b* are in their folded-down non-usage position. The swing-action retainers 3*b* here lie approximately horizontally on the base portion 2 of the washware carrier 1.

Thanks to the selected advantageous embodiment of the swing-action retainers 3*b* as folding spines in the exemplary embodiment shown, these do not protrude significantly from the base portion 2 in their non-usage position and consequently do not hamper loading of the washware carrier with items of cutlery or crockery, or at least do not do so to any great extent. The folding spines advantageously have a lozenge-shaped cross-section, which, in the usage position of the folding spines, minimizes the contact area between their edges and an abutting item of washware, and thus also contributes to reduction of the build-up of marks during a drying process. At variance from the embodiment represented, a locking function, for example in the form of a latching of the swing-action retainers 3*b,* can also be provided for the non-usage position.

After folding down of the swing-action retainers 3*b,* the distance between two adjacent retainers 3 is determined only by the fixed retainers 3*a* still remaining in an upright attitude. In the exemplary embodiment shown with swing-action and fixed retainers 6*b* and 6*a* respectively arranged alternately and equidistant from each other, the distance between two adjacent retainers 3 is thus doubled through the folding down of the swing-action retainers 3*b*. Each couple of adjacent fixed retainers 3*a* now form an enlarged accommodation space 4', in that larger items of washware, such as, in the case of a cutlery drawer, knives with broader handles or, in the case of a crockery basket, deeper dishes, can now also be inserted.

Besides the usage and non-usage positions illustrated, further positions, in particular intermediate positions, can also be provided for retainers 6*b* embodied for swing action, in which if appropriate a corresponding locking function can also be provided.

Although the invention has been illustrated using the example of a cutlery drawer, the invention can also be applied to other washware carriers, such as crockery baskets, in an analogous manner. The invention is otherwise not limited to the exemplary embodiments represented. Rather, the subject matter of the invention may comprise all combinations of the individual features described, as shown or described in the claims, the description and the figures, and a corresponding combination thereof, insofar as it appears technically possible or sensible.

The invention claimed is:

1. A washware carrier for the accommodation of washware to be washed in dishwasher, said washware carrier comprising:

a base portion; and a multiplicity of retainers for the washware traversing the washware carrier, said retainers being arranged in a row, with a first plurality of retainers being fixed and a second plurality of retainers configured for swing action, said first and second pluralities of retainers being arranged in a random sequence;

wherein the random sequence includes at least a first swing action retainer arranged linearly between a first fixed retainer and a second fixed retainer.

2. The washware earner of claim 1, constructed in the form of a crockery basket or cutlery drawer.

3. The washware carrier of claim 1, wherein the first and second pluralities of retainers are arranged in alternating sequence such that each swing action retainer is arranger next to a corresponding fixed retainer in a one to one relationship.

4. The washware carrier of claim 1, further comprising an axle, said second plurality of retainers being mounted on the axle.

5. The washware carrier of claim 4, wherein the axle is a common axle.

6. The washware carrier of claim 4, wherein the axle is a common rotatable axle, said second plurality of retainers being mounted in a torque-free manner on the common rotatable axle.

7. The washware carrier of claim 6, further comprising an actuating element arranged on the rotatable axle.

8. The washware carrier of claim 1, wherein the second plurality of retainers is lockable at least in a usage position, in which the first and second pluralities of retainers are arranged in the row.

9. The washware carrier of claim 1, wherein the first plurality of retainers has each at least two fastening portions and a central portion configured to connect the at least two fastening portions to each other, said fastening portions being configured to fasten the first plurality of retainers onto the base portion.

10. The washware carrier of claim 9, wherein the central portions of the first plurality of retainers are arranged at a distance from the base portion.

11. The washware carrier of claim 1, wherein the first plurality of retainers is essentially embodied in an essentially M-shaped or essentially U-shaped or V-shaped manner.

12. The washware carrier of claim 9, further comprising an axle arranged in an area underneath the central portions of the first plurality of retainers, said second plurality of retainers being mounted on the axle.

13. The washware carrier of claim 1, wherein the second plurality of retainers are embodied as folding spines.

14. A dishwasher, comprising at least one washware earner for the accommodation of washware, said washware carrier having a base portion, and a multiplicity of retainers for the washware traversing the washware carrier, said retainers being arranged in a row, with a first plurality of retainers being fixed and a second plurality of retainers configured for swing action, said first and second pluralities of retainers being arranged in a random sequence; wherein the random sequence includes at least a first swing action retainer arranged linearly between a first fixed retainer and a second fixed retainer.

15. The dishwasher of claim 14, wherein the washware earner is a crockery basket or cutlery drawer.

16. The dishwasher of claim 14, wherein the first and second pluralities of retainers are arranged in alternating sequence such that each swing action retainer is arranger next to a corresponding fixed retainer in a one to one relationship.

17. The dishwasher of claim 14, wherein the washware carrier has an axle, said second plurality of retainers being mounted on the axle.

18. The dishwasher of claim 17, wherein the axle is a common axle.

19. The dishwasher of claim 17, wherein the axle is a common rotatable axle, said second plurality of retainers being mounted in a torque-free manner on the common rotatable axle.

20. The dishwasher of claim 19, wherein the washware carrier has an actuating element arranged on the common rotatable axle.

21. The dishwasher of claim 14, wherein the second plurality of retainers is lockable at least in a usage position, in which the first and second pluralities of retainers are arranged in the row.

22. The dishwasher of claim 14, wherein the first plurality of retainers has each at least two fastening portions and a central portion configured to connect the at least two fastening portions to each other, said fastening portions being configured to fasten the first plurality of retainers onto the base portion.

23. The dishwasher of claim 22, wherein the central portions of the first plurality of retainers are arranged at a distance from the base portion.

24. The dishwasher of claim 14, wherein the first plurality of retainers is essentially embodied in an essentially M-shaped or essentially U-shaped or V-shaped manner.

25. The dishwasher of claim 22, wherein the washware carrier has an axle arranged in an area underneath the central portions of the first plurality of retainers, said second plurality of retainers being mounted on the axle.

26. The dishwasher of claim 14, wherein the second plurality of retainers are embodied as folding spines.

* * * * *